US010076192B2

(12) United States Patent
Ichigaya

(10) Patent No.: US 10,076,192 B2
(45) Date of Patent: Sep. 18, 2018

(54) AIR-CIRCULATING MAT

(71) Applicant: SFT Laboratory Co., Ltd., Tokyo (JP)

(72) Inventor: Hiroshi Ichigaya, Tokyo (JP)

(73) Assignee: SFT LABORATORY CO., LTD., Tokyo (JP)

( * ) Notice: Subject to any disclaimer, the term of this patent is extended or adjusted under 35 U.S.C. 154(b) by 0 days.

(21) Appl. No.: 15/312,336

(22) PCT Filed: May 21, 2014

(86) PCT No.: PCT/JP2014/063482
§ 371 (c)(1),
(2) Date: Nov. 18, 2016

(87) PCT Pub. No.: WO2015/177887
PCT Pub. Date: Nov. 26, 2015

(65) Prior Publication Data

US 2017/0105536 A1 Apr. 20, 2017

(51) Int. Cl.
*A47C 7/74* (2006.01)
*A47C 7/02* (2006.01)

(52) U.S. Cl.
CPC ..... *A47C 7/744* (2013.01); *A47C 7/021* (2013.01)

(58) Field of Classification Search
CPC ..... A47C 7/744; A47C 7/021
USPC ..... 297/180.11, 180.13, 180.14
See application file for complete search history.

(56) References Cited

U.S. PATENT DOCUMENTS 4,413,857 A * 11/1983 Hayashi ..... A47C 7/74 297/180.11
4,981,324 A * 1/1991 Law ..... A47C 7/74 297/180.11
5,067,771 A * 11/1991 Ellis ..... A47C 1/16 297/180.11

(Continued)

FOREIGN PATENT DOCUMENTS

CN 202184477 U 4/2012
EP 1 535 547 A1 6/2005

(Continued)

OTHER PUBLICATIONS

PCT/JP2014/063482, International Search Report dated Jun. 24, 2014 (One (1) page).

(Continued)

*Primary Examiner* — Rodney B White
(74) *Attorney, Agent, or Firm* — Crowell & Moring LLP

(57) ABSTRACT

An air-circulating mat for a seating device is disclosed. At a lower end part of a bag-shaped body, an opening portion for mounting an air blower is formed. A spacer ensures an air path through which the air flows inside the bag-shaped body and is contained in the bag-shaped body. This spacer is made of plastic and includes a plurality of convex parts and a plurality of flexible connection portions with flexibility for connecting the adjacent convex parts. At an upper end part on the right side of the bag-shaped body is an air circulating portion for discharging the air flowing through the air path to the outside. A battery containing portion for containing a battery that supplies electric power to the air blower is provided so as to continue to a predetermined end portion of the spacer located on a back portion side of a user in use.

9 Claims, 11 Drawing Sheets

(56) References Cited

U.S. PATENT DOCUMENTS 5,382,075 A * 1/1995 Shih ..... A47C 7/74
297/180.11
5,613,729 A * 3/1997 Summer, Jr. ..... A47C 7/74
297/180.11
5,626,387 A * 5/1997 Yeh ..... A47C 7/744
297/180.11
5,640,728 A * 6/1997 Graebe ..... A47C 7/744
5/423
5,692,952 A * 12/1997 Chih-Hung ..... B60H 1/00285
297/180.11
5,924,767 A * 7/1999 Pietryga ..... A47C 7/74
297/180.11
6,786,273 B2 * 9/2004 Ichigaya ..... A43B 7/081
165/121
7,438,356 B2 * 10/2008 Howman ..... A47C 7/021
297/180.11
7,708,338 B2 * 5/2010 Wolas ..... A47C 7/72
297/180.1
8,129,013 B2 3/2012 Ichigaya
8,556,337 B1 * 10/2013 Cornitius-Cary ..... A47C 7/021
297/180.11 X
9,192,532 B2 * 11/2015 Primo ..... A47C 7/744
9,375,547 B2 * 6/2016 Augustine ..... A47C 7/744
2006/0112826 A1 6/2006 Ichigaya
2009/0208693 A1 8/2009 Ichigaya
2010/0301642 A1 * 12/2010 Negrini ..... B60N 2/5692
297/180.11

FOREIGN PATENT DOCUMENTS

EP 1 985 208 A1 10/2008
JP 2004-141210 A 5/2004
JP 4067034 B2 3/2008
WO WO 2004/012564 A1 2/2004
WO WO 2014/008997 A1 1/2014

OTHER PUBLICATIONS

European Supplementary Search Report issued in European counterpart application No. 14892751.0-1653 / 3146869 dated Jan. 4, 2018 (Seven (7) pages).

* cited by examiner

AIR-CIRCULATING MAT

TECHNICAL FIELD

The present invention relates to an air-circulating mat used as a mat for a seating device such as a chair, for example, for cooling a human body by causing air to flow.

BACKGROUND ART

Recently, an air-circulating mat for evaporating sweat from a human body by causing air to flow has been put into practice (see Patent document 1, for example). This air-circulating mat includes a spacer, a bag-shaped body, and air blowing means and is used by being placed on a seating device such as a chair. The air-circulating mat is formed having a shape like a home base of baseball. The spacer is to ensure an air path through which the air flows inside the air-circulating mat and has a substantially regular square-shaped spacer body portion and a substantially trapezoidal shaped spacer extension portion. The bag-shaped body is to cover the spacer and has a bag body portion containing the spacer body portion and a bag extension portion continuing to the bag body portion and containing the spacer extension portion. Here, when the air-circulating mat is used, a user is seated on the bag body portion. The air blowing means is for generating a flow of air in the air path ensured by the spacer. This air blowing means is mounted on the bag extension portion of the bag-shaped body.

RELATED ART DOCUMENTS

Patent Documents

Patent document 1: WO 2004/012564

DISCLOSURE OF THE INVENTION

Problems to be Solved by the Invention

In the prior-art air-circulating mat, when a power supply device storing a battery as a power supply for driving the air blowing means is used, the power supply device is provided at a spot close to the air blowing means or specifically, on the spacer extension portion. Thus, when the prior-art air-circulating mat is used on the chair, the spacer extension portion is hung from the chair, and the heavy power supply device is mounted thereon. Therefore, the air-circulating mat itself is shifted down by the weight of the power supply device, and in order to prevent that, further means such as tying the air-circulating mat itself to the chair is needed, which makes the structure complicated, increases a cost and inhibits convenience, which are problems.

The present invention was made on the basis of the aforementioned circumstances and has an object to provide an air-circulating mat for a seating device, which can prevent shifting and falling with simple constitution and improve convenience and further can be manufactured inexpensively.

Means of Solving the Problems

In order to achieve the aforementioned object, the present invention is an air-circulating mat used by being laid on a seating device and is characterized by including a bag-shaped body formed with a bag shape by a lower sheet and an upper sheet from which air does not leak easily and which has moisture permeability and having an opening portion formed on a predetermined end portion of the lower sheet or the upper sheet; air blowing means mounted on the opening portion and causing air to flow through the bag-shaped body by forcedly suctioning the air from an outside or by forcedly discharging it to the outside; a spacer for ensuring an air path through which the air flows inside the bag-shaped body; an air circulating portion provided on a predetermined end portion of the bag-shaped body located on a side substantially opposite to the air blowing means with respect to a center part of the bag-shaped body and discharging the air flowing through the air path to the outside or taking in the outside air into the air path; and a battery containing portion provided so as to continue to a predetermined end portion of the spacer located on a back portion side of a user in use and containing one or a plurality of batteries as power supply means for supplying electric power to the air blowing means.

In the air-circulating mat of the present invention, by providing the battery containing portion for containing the battery so as to continue to the predetermined end portion of the spacer located on the back portion side of the user in use, when this air-circulating mat is used for the seating device such as a chair, the battery containing portion can be arranged so as to be located on the back side of the user and thus, even if the battery is contained in the battery containing portion, the air-circulating mat does not shift and fall from the seating device by the weight of the battery. As described above, in the present invention, the problem of shifting and falling can be solved by simple constitution. Moreover, by arranging the battery containing portion so as to be located on the back side of the user, the weight of the battery is applied to a seating surface of the seating device, whereby close contact between the seating surface of the seating device and the air-circulating mat is further improved, and stability of the air-circulating mat is increased, and hence, convenience thereof is improved.

Moreover, in the air-circulating mat of the present invention, the spacer made of plastic and including a plurality of convex parts and a plurality of flexible connection portions with flexibility for connecting the adjacent convex parts is preferably used. Here, the convex part has a frame-shaped portion, a rising portion made of four column portions, or two wall portions, or two column portions and one wall portion, each of them having one end formed to rise from the frame-shaped portion, and a rising connection portion for connecting the other ends of the rising portion. Since such spacer has a structure with extremely small air resistance, the air-circulating mat using such spacer can drastically reduce power consumption of the air blowing means for causing the air to flow through the spacer. Particularly, if a dry cell is used as the power supply means, the dry cell can be used for a long time. Moreover, since the adjacent, convex parts are connected by the flexible connection, portion with flexibility, the air-circulating mat of the present invention is rich in flexibility. Thus, for example, the air-circulating mat of the present invention can be folded with a side where the frame-shaped portion is formed inside or the air-circulating mat of the present invention can be rolled by using an end portion of the spacer on which the battery containing portion is formed as a core and with a side where the frame-shaped portion is formed inside. Therefore, the air-circulating mat of the present invention can be carried and used for various types of the seating device.

Furthermore, in the air-circulating mat of the present invention, the spacer and the battery containing portion are preferably integrally fabricated by injection molding of plastic. As a result, it is no longer necessary to fabricate the battery containing portion and the spacer separately, whereby a manufacturing cost can be reduced.

Effects of the Invention

In the air-circulating mat of the present invention, by providing the battery containing portion for containing the battery so as to continue to the predetermined end portion of the spacer located on the back portion side of the user in use, when this air-circulating mat is used for the seating device such as a chair, the battery containing portion can be arranged so as to be located on the back side of the user and thus, even if the battery is contained in the battery containing portion, the air-circulating mat does not shift and fall from the seating device by the weight of the battery. Moreover, if the battery containing portion is arranged so as to be located on the back side of the user, the weight of the battery is applied to the seating surface of the seating device, close contact between the seating surface of the seating device and the air-circulating mat is further improved, and stability of the air-circulating mat is increased, whereby convenience thereof is improved.

MODE FOR CARRYING OUT THE INVENTION

Embodiments for putting the invention according to the present application into practice will be described below by referring to the attached drawings.

[First Embodiment]

Figure 1:
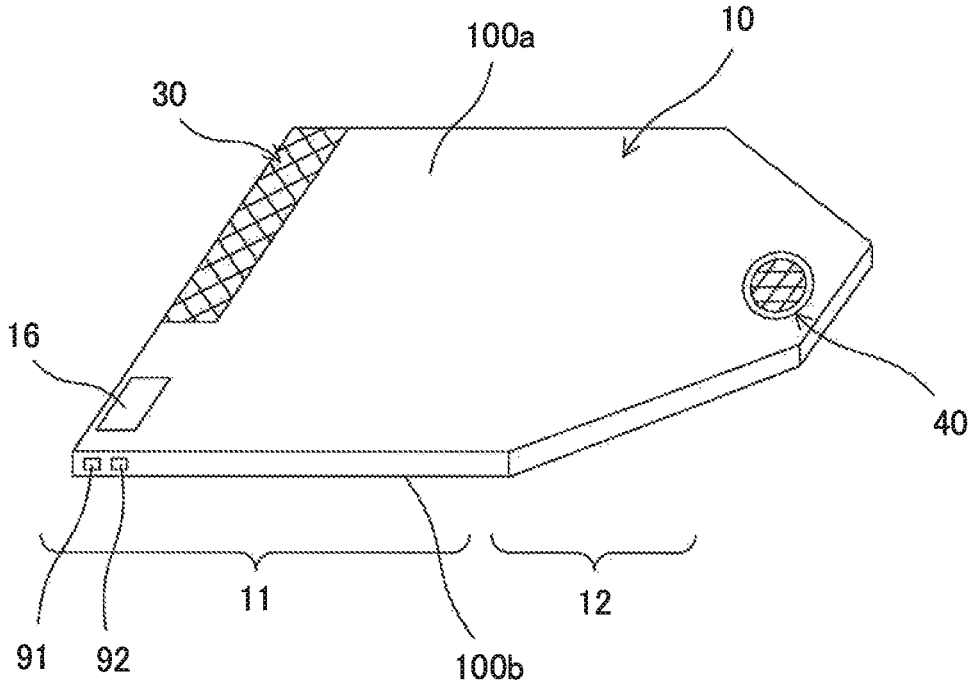
FIG. 1 is a schematic perspective view of an air-circulating mat which is a first embodiment of the present invention.
Figure 2:
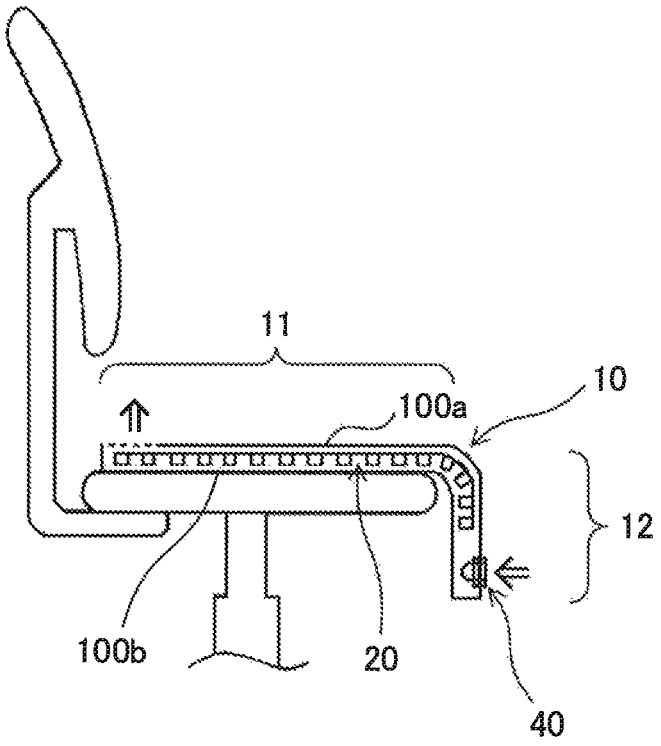
FIG. 2 is a view for explaining a use state of the air-circulating mat.
Figure 3A:
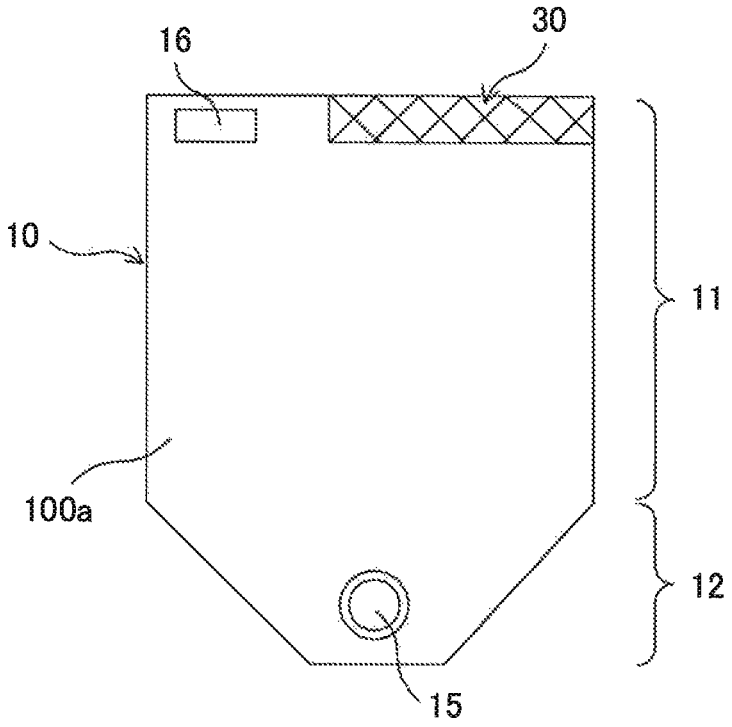
FIG. 3A is a schematic plan view of a bag-shaped body in the air-circulating mat and FIG. 3B is a schematic plan view of a spacer in the air-circulating mat.
Figure 3B:
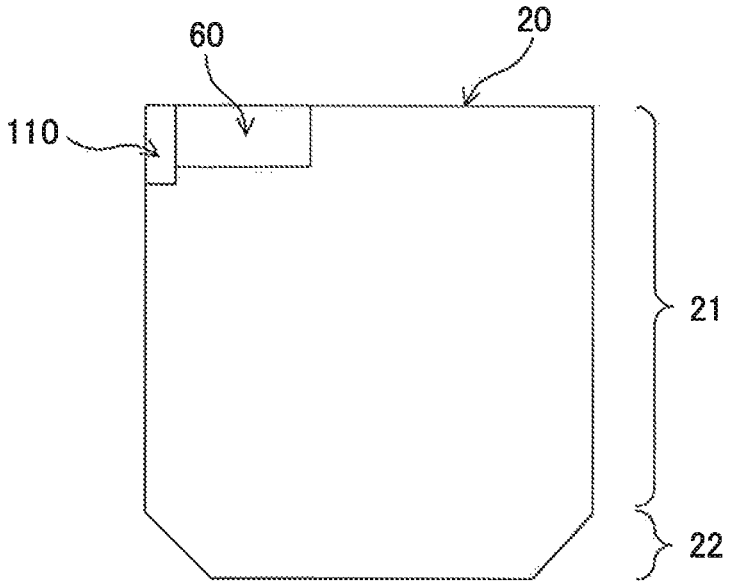
Figure 4:
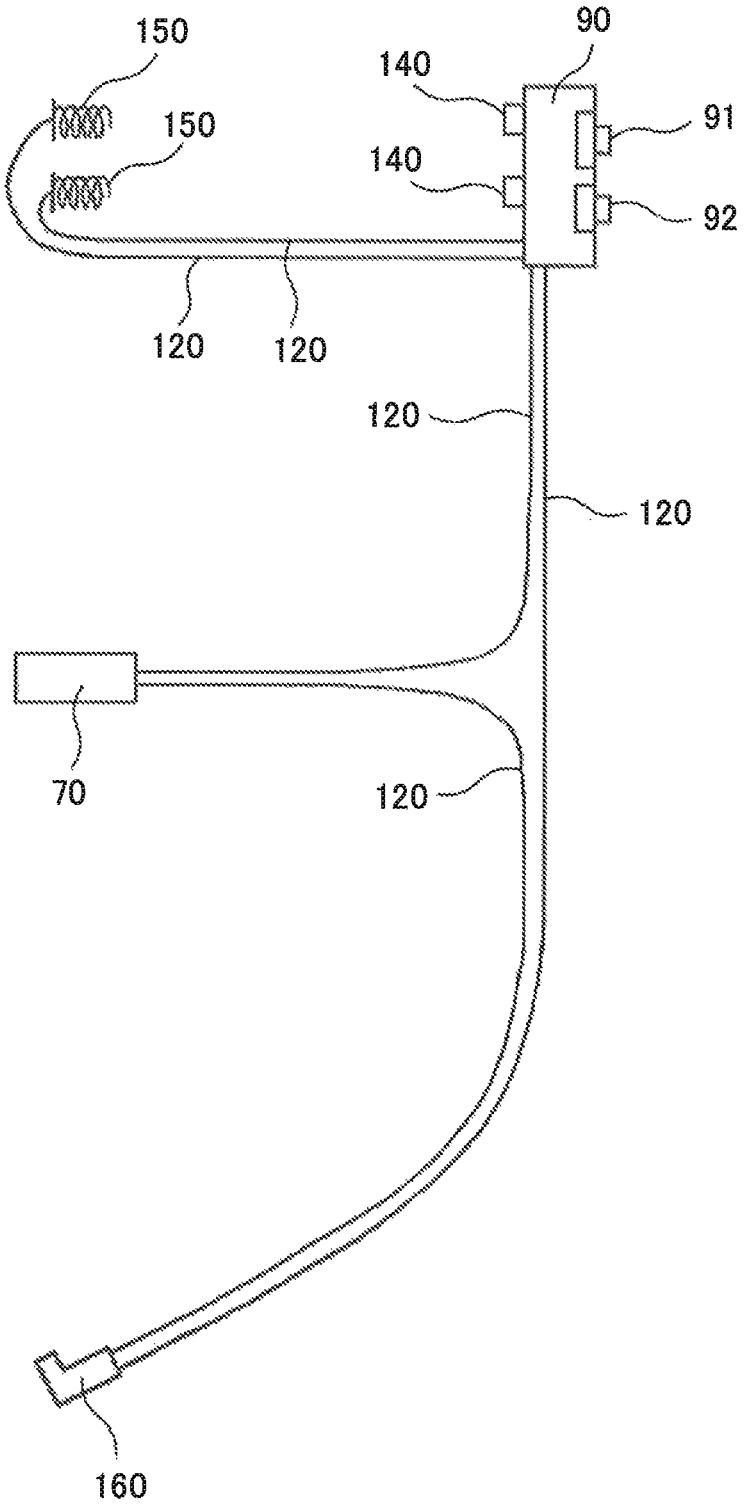
FIG. 4 is a schematic view of a power supply circuit obtained by connecting each electric component used in the air-circulating mat.
Figure 5:
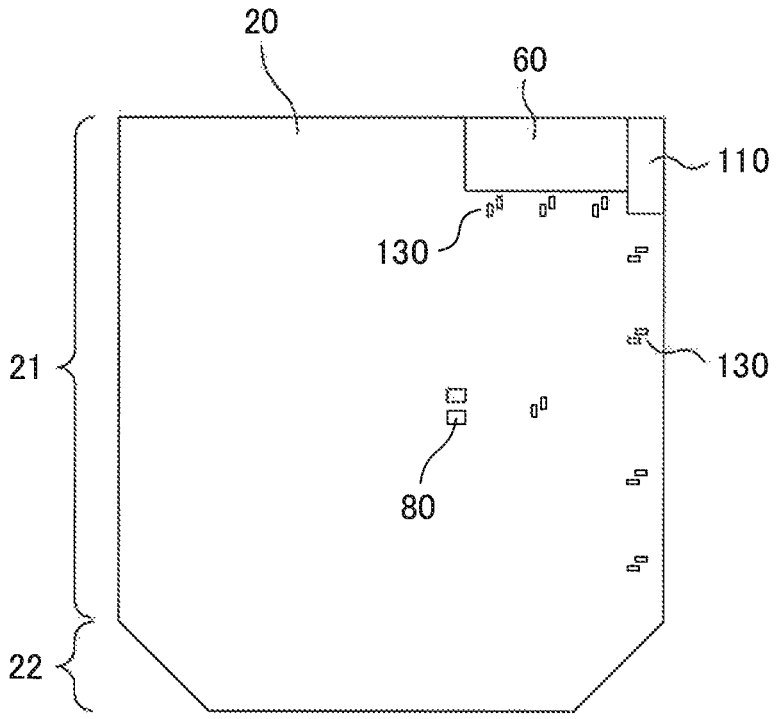
FIG. 5 is a schematic rear view for explaining a position relation of each portion of the spacer in the air-circulating mat.
Figure 6:
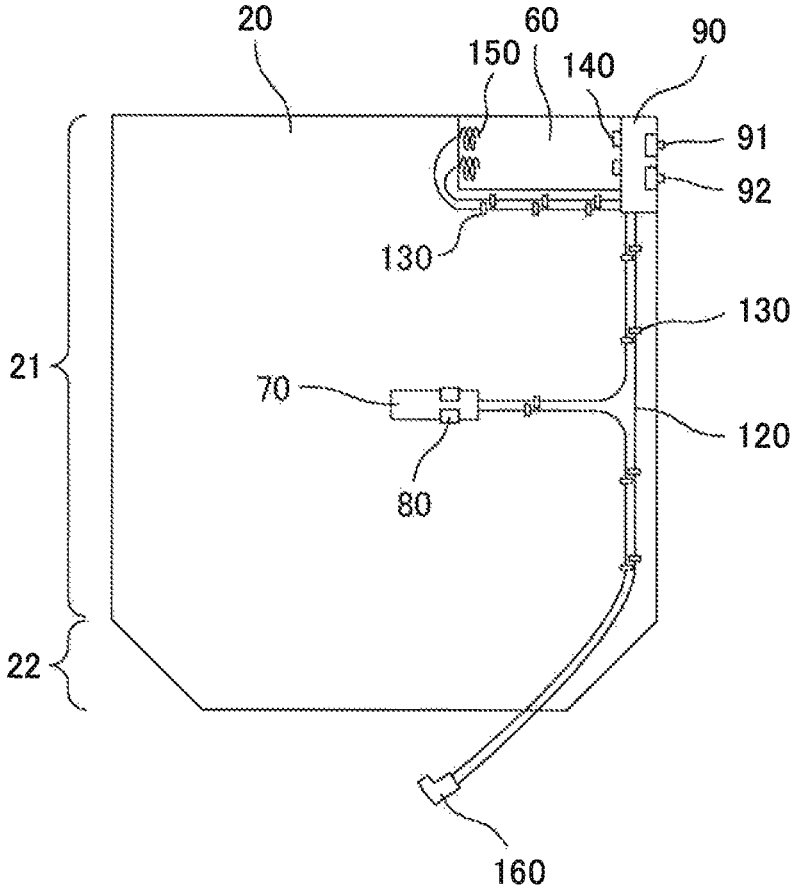
FIG. 6 is a schematic rear view of the spacer on which each electric component is mounted.

First, a first embodiment of the present invention will be described by referring to the attached drawings. FIG. 1 is a schematic, perspective view of an air-circulating mat which is a first embodiment of the present invention, FIG. 2 is a view for explaining a use state of the air-circulating mat, FIG. 3A is a schematic plan view of a bag-shaped body in the air-circulating mat, and FIG. 3B is a schematic plan view of a spacer in the air-circulating mat. Moreover, FIG. 4 is a schematic view of a power supply circuit obtained by connecting each electric component used in the air-circulating mat, FIG. 5 is a schematic rear view for explaining a position relation of each portion of the spacer in the air-circulating mat, and FIG. 6 is a schematic rear view of the spacer on which each electric component is mounted.

The air-circulating mat of the first embodiment is used by being laid on a seating device and as illustrated in FIGS. 1 to 6, it includes a bag-shaped body 10, a spacer 20, an air circulating portion 30, air blowing means 40, a plurality of batteries (not shown) as power supply means, a battery containing portion 60, seating switch means 70, a seating switch mounting portion 80, a control substrate 90, a control substrate containing portion 110, cables 120, a plurality of cable clips 130, two positive electrodes 140, two negative electrodes 150, and a connector 160. In the first embodiment, a chair is used as the seating device, and a case in which the air-circulating mat is used as a mat for a chair is explained.

The bag-shaped body 10 is to cover the spacer 20, and as illustrated in FIGS. 1 and 3A, it has a bag body portion 11 which is a portion in contact with buttocks (human body) and a bag extension portion 12 continuing to the bag body portion 11. When the bag-shaped body 10 is viewed from a front side, the bag body portion 11 is formed having a substantially regular square shape, the bag extension portion 12 is formed having a substantially trapezoidal shape, and thus, the bag-shaped body 10 has a shape like a home base used in baseball in entirety. This bag-shaped body 10 is created by sewing an upper sheet 100*a* and a lower sheet 100*b* together into a bag shape. A material from which air does not leak easily and which has moisture permeability is used for the upper sheet 100*a*, while a material from which air does not leak easily is used for the lower sheet 100*b*. In use of the air-circulating mat, the bag body portion 11 is arranged on the seating surface of the chair.

In the bag extension portion 12, as illustrated in FIG. 3A, an opening portion 15 for mounting the air blowing means 40 is formed. This opening portion 15 can be formed in either one of the upper sheet 100*a* and the lower sheet 100*b*, but in the first embodiment, the opening portion 15 is formed at a lower end part of the upper sheet 100*a*. Moreover, on a predetermined end portion of the bag-shaped body 10 except the vicinity of the opening portion 15, an opening portion 16 through which the battery is taken out of/put into the battery containing portion 60 is formed. Specifically, in the first embodiment, this opening portion 16 is formed at a left end portion of the bag body portion 11 located on a side substantially opposite to the opening portion 15 with respect, to a center part of the bag-shaped body 10. At a right end portion of the bag body portion 11 located on the side substantially opposite to the opening portion 15 with respect to the center part of the bag-shaped body 10, the air circulating portion 30 is formed.

The spacer 20 is to ensure an air path through which the air flows inside the bag-shaped body 10. For this spacer 20, a spacer made of plastic is used. The spacer 20, as illustrated in FIG. 3B, has a spacer body portion 21 having a substantially regular square shape and a spacer extension portion 22 having a substantially trapezoidal shape. Here, an upper end part on the left side of the spacer body portion 21 is missing and the battery containing portion 60 and the control substrate containing portion 110 are provides so as to continue to the spacer body portion 21 of the missing portion. When the spacer 20 is put into the bag-shaped body 10, the spacer body portion 21, the battery containing port ion 60, and the control substrate containing portion 110 are contained in the bag body portion 11, and the spacer extension portion 22 is contained in the bag extension portion 12.

In the air-circulating mat, since the air blowing means 40 takes the outside air into the bag-shaped body 10, a pressure inside the bag extension portion 12 becomes a positive pressure. Thus, the spacer 20 for ensuring the air path, only needs to be arranged to the vicinity of the air blowing means 40 (opening portion 15) in the bag-shaped portion 10 as illustrated in FIG. 2.

Figure 7A:
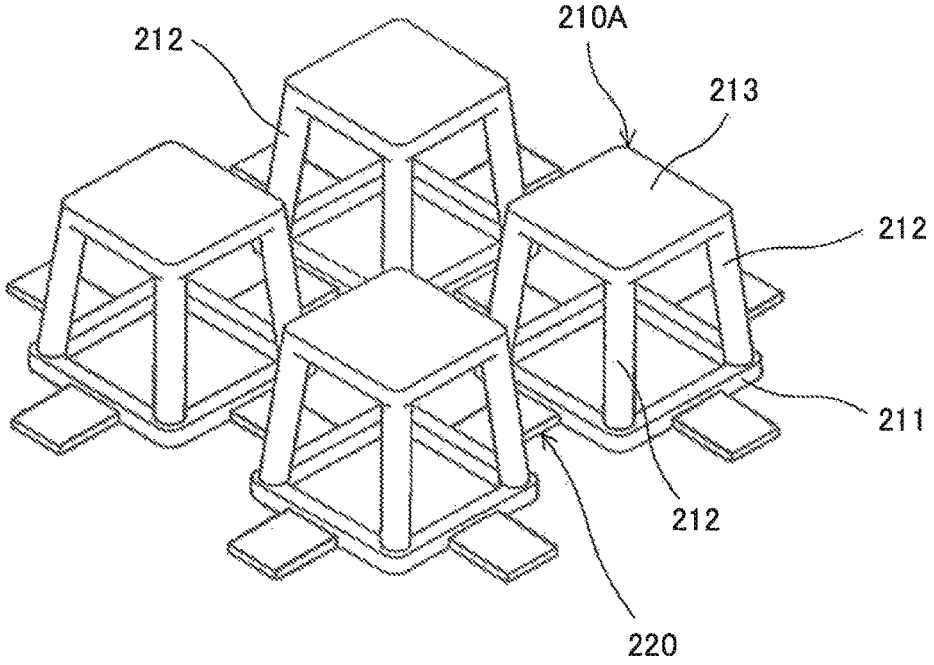
FIG. 7A is a schematic partial perspective view of the spacer having normal convex parts and FIG. 7B is a schematic partial perspective view of the spacer having pressure-resistant convex parts.
Figure 7B:
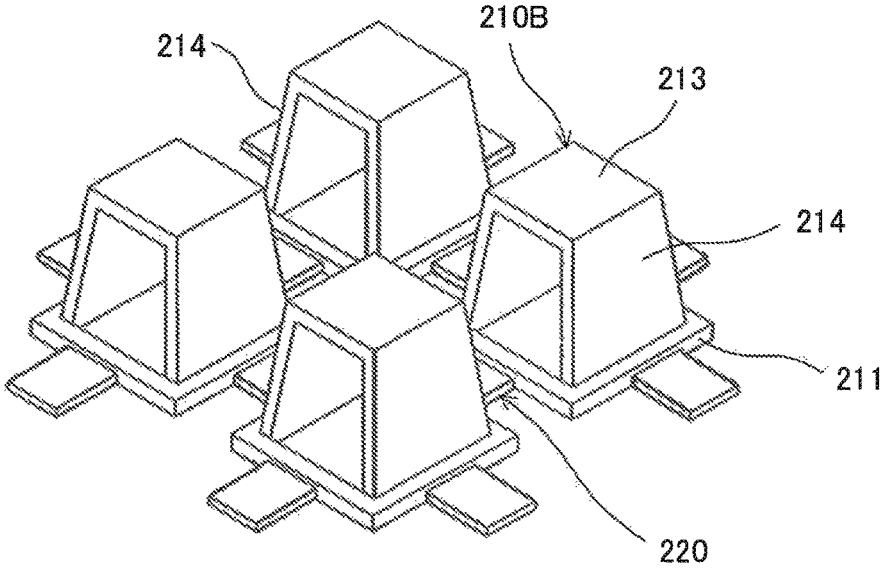
Figure 8:
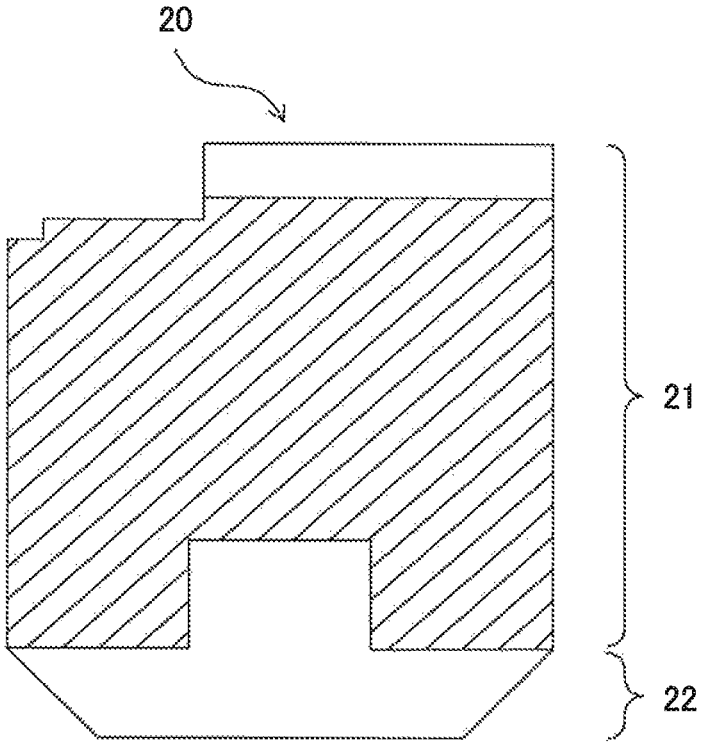
FIG. 8 is a view for explaining a position relation between a portion where the normal convex parts are formed and a portion where the pressure-resistant convex parts are formed in the spacer having both the normal convex parts and the pressure-resistant convex parts.

In the first embodiment, a spacer having a structure with extremely small air resistance is used for the spacer 20. The structure of the spacer 20 will be described. FIG. 7A is a schematic partial perspective view of the spacer having normal convex parts, FIG. 7B is a schematic partial perspective view of the spacer having pressure-resistant convex parts, and FIG. 8 is a view for explaining a position relation between a portion where the normal convex parts are formed and a portion where the pressure-resistant convex parts are formed in the spacer having both the normal convex parts and the pressure-resistant convex parts.

The spacer illustrated in FIG. 7A includes a plurality of normal convex parts 210A and a plurality of flexible connection portions 220. The flexible connection portion 220 connects the adjacent normal convex parts 210A and has flexibility. The normal convex part 210A has a frame-shaped portion 211, four column portions 212 which constitute a rising portion formed having one end continuing to the frame-shaped portion 211 and rising from the frame-shaped portion 211, and a rising connection portion 213 connecting the other ends of the four column portions 212. This normal convex part 210A is given strength to such a degree that it is not crushed even if a weight of a human body is applied. In the normal convex part 210A, since the rising portion is made of the four column portions 212, air resistance is small against the air flowing in any direction. Since the flexible connection portion 220 has flexibility, this spacer has flexibility and can be folded or rolled with a side where the frame-shaped portion 211 is formed inside. On the other hand, the spacer illustrated in FIG. 7B includes a plurality of pressure-resistant convex parts 210B and a plurality of flexible connection portions 220. The flexible connection portion 220 connects the adjacent pressure-resistant convex parts 210B and has flexibility. A difference between the pressure-resistant convex part 210B and the normal convex part 210A is that in the pressure-resistant convex part 210B the rising portion is constituted by two wall portions 214 formed so that one ends rise from the frame-shaped portion 211 instead of the four column portions. Except that point, a structure of the pressure-resistant convex part 210B is the same as the structure of the normal convex part 210A. As described above, since the pressure-resistant convex part 210B has the two wall portions 214, it has more excellent pressure-resistant than the normal convex part 210A. Moreover, in the pressure-resistant convex part 210B, air resistance in a direction substantially in parallel with the wall portion is small but the air resistance in a direction substantially perpendicular to the wall portion 214 is not so small. Thus, when the spacer having the pressure-resistant convex parts 210B is used, the spacer needs to be arranged so that a surface of the wall portion 214 is in substantially parallel with the direction in which the air flows. The structure of such spacer is described in Japanese Patent Mo. 4067034, for example. Thus, detailed explanation of this spacer will be omitted.

In the first embodiment, a spacer having both the normal convex parts 210A and the pressure-resistant convex parts 210B is used as the spacer 20. Specifically, as illustrated in FIG. 8, the pressure-resistant convex parts 210B are formed at the center part or the like where a large pressure is applied, while the normal convex parts 210A are formed on an upper end part and a lower-end center part where a pressure is not applied much in the spacer body portion 21. As described above, for the spacer body portion 21, the normal convex parts 210A and the pressure-resistant convex parts 210B are both used. Moreover, on the spacer extension portion 22, the normal convex parts 210A are formed. Here, in FIG. 8, the portion where the pressure-resistant convex parts 210B are formed is indicated by shading, while the portion where the normal convex parts 210A are formed is indicated by solid white. In the spacer 20, a side where the frame-shaped portions 211 are formed is a side in contact with the buttocks (human body) and a side where the rising connection portions 213 are formed is a side in contact with the chair. In this embodiment, a "front surface" of the spacer 20 refers to a surface on the side with which the buttocks of the user are brought into contact in use, and a "back surface" thereof refers to a surface on the side in contact with the chair in use.

In the spacer 20, as illustrated in FIG. 5, the battery containing portion 60 for containing a plurality of the batteries, the seating switch mounting portion 80 for mounting the seating switch means 70, the control substrate containing portion 110 for containing the control substrate 90, and a plurality of cable clips 130 are provided at predetermined spots of the spacer body portion 21. In the first embodiment, the spacer body portion 21, the spacer extension portion 22, the battery containing portion 60, the seating switch mounting portion 80, the control substrate containing portion 110, and the cable clips 130 are made integrally by injection molding of plastic. Here, the battery containing portion 60 is provided so as to continue to a predetermined end portion of the spacer 20 located on a back portion side of the user in use. In the example in FIG. 5, the spacer body portion 21 is formed having a shape such that an upper end part on the right side of the spacer body portion 21 is missing, and the battery containing portion 60 is provided so as to continue to the spacer body portion 21 of the missing portion. Therefore, the battery containing portion 60 and the air blowing means 40 are arranged separately.

The air blowing means 40 is to cause the air to flow through the bag-shaped body 10 by forcedly suctioning the outside air. Here, as a method of mounting the air blowing means 40 to the opening portion 15, a method of sandwiching an end portion of the bag-shaped body 10 located in the periphery of the opening portion 15 by two components of the air blowing means 40 or a method of using planar fasteners provided on an end portion of the bag-shaped body 10 located around the opening portion 15 and a predetermined portion of the air blowing means 40 or the like can be employed. Moreover, as described above, since the air resistance is small in the spacer 20 used in this embodiment, a propeller fan with a low static pressure can be used as the air blowing means 40.

The air circulating portion 30 is to discharge the air flowing through the bag-shaped body 10 to the outside. This air circulating portion 30 is, as illustrated in FIG. 3A, provided at the right end portion of the bag body portion 11 located on the side substantially opposite to the air blowing means 40 with respect to the center part of the bag-shaped body 10 in order to cause the air to flow through the entire bag-shaped body 10.

The plurality of batteries as the power supply means is to supply electric power to the air blowing means 40. Here, four AA batteries are used as the power supply means, Specifically, the four batteries are divided into two sets, each set having two batteries, and the two batteries in each set are connected in series and the batteries in two sets are connected in parallel. Each of the batteries is contained in the battery containing portion 60 from the front surface side of the spacer 20. Thus, the opening portion 16 is formed at a portion of the upper sheet 100*a* corresponding to the battery containing portion 60.

A power supply circuit for supplying electric power to the air blowing means 40 from the power supply means is constituted by, as illustrated in FIG. 4, electric components, that is, the seating switch means 70, the control substrate 90, the positive electrodes 140 and 140, the negative electrodes 150 and 150, and the connector 160. The seating switch means 70 is to turn on the power supply circuit when the user is seated. On the control substrate 90, a flowrate setting switch 91 and a main switch 92 of the power supply circuit are mounted. When the user operates the flowrate setting switch 31, the control substrate 90 controls an amount of electric power to be supplied to the air blowing means 40 so that the air in a flowrate set by the flowrate setting switch 31 flows through the space in the spacer 20. The positive electrode 140 and the negative electrode 150 are electrodes connected to the battery. Here, a planar electrode not having elasticity is used as the positive electrode 140, while an elastic electrode using a spring or the like is used as the negative electrode 150. The connector 160 is to connect the power supply circuit to the air blowing means 40. By connecting these electric components to each other by the plurality of cables 120, the power supply circuit is obtained. This power supply circuit is mounted on the spacer 20 as illustrated in FIG. 6. Here, a plurality of the cables 120 are fixed by the cable clips 130. As described above, the electric power of the battery is supplied to the air blowing means 40 through the negative electrodes 150, the positive electrodes 140, the control substrate 90, the seating switch means 70, and the connector 160.

In the first embodiment, by incorporating the seating switch means 70 for turning on the power supply circuit when the user is seated in the air-circulating mat, even in a state where the main switch 92 of the power supply circuit is on, if the user is not seated on the air-circulating mat, the power supply circuit is in the off state, and particularly when the battery is used as the power supply means, wasteful consumption of the battery caused by forgetting to turn off the switch can be prevented. Moreover, as described above, electric component mounting portions, that is, the battery containing portion 60, the seating switch mounting portion 80, the control substrate containing portion 110, and the plurality of cable clips 130 are formed integrally with the spacer 20 and thus, each of the electric components of the power supply circuit can be directly mounted on the spacer 20.

Figure 9:
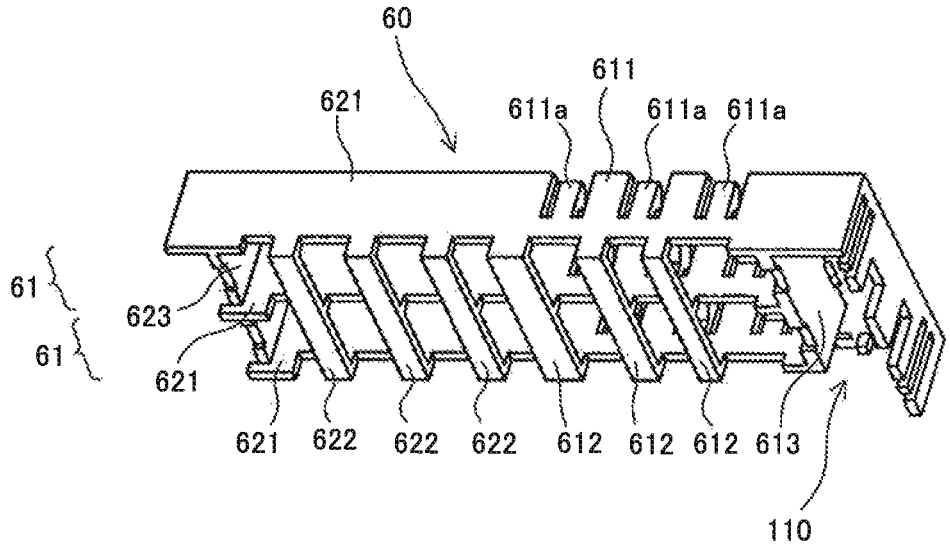
FIG. 9 is a schematic perspective view of a battery containing portion when viewed from a back surface side of the spacer.
Figure 10A:
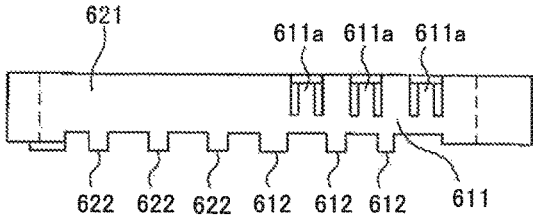
FIG. 10 A is a schematic side view of the battery containing portion.
FIG. 10B is a schematic view of the battery containing portion when viewed from the back surface side of the spacer.
FIG. 10C is a schematic cross-sectional view of the battery containing portion in an A-A arrow-view direction.
FIG. 10D is a schematic cross-sectional view of the battery containing portion in a B-B arrow-view direction.
Figure 10B:
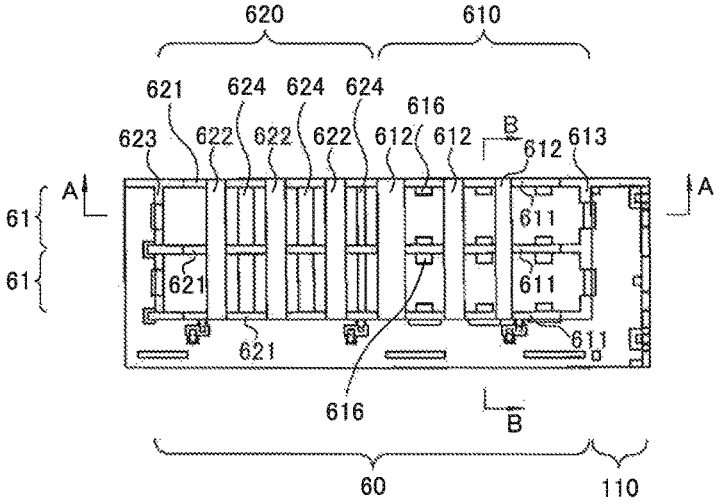
Figure 10D:
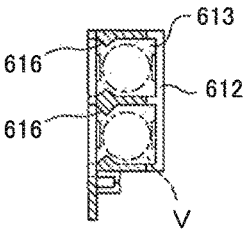
Figure 10C:
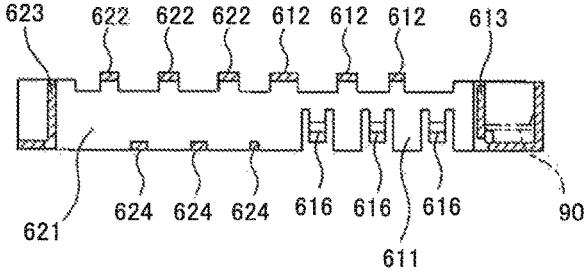

Subsequently, the battery containing portion 60 will be described. FIG. 9 is a schematic perspective view of the battery containing portion 60 when viewed from the back surface side of the spacer 20, FIG. 10A is a schematic side view of the battery containing portion 60, FIG. 10B is a schematic view of the battery containing portion 60 when viewed from the back surface side of the spacer 20, FIG. 10C is a schematic cross-sectional view of the battery containing portion 60 in an A-A arrow-view direction, and FIG. 10D is a schematic cross-sectional view of the battery containing portion 60 in a B-B arrow-view direction. As described above, the battery containing portion 60 is integrally fabricated with the spacer body portion 21 and the spacer extension portion 22 by injection molding of plastic.

The battery containing portion 60 is, as illustrated in FIGS. 9 and 10B, provided adjacent to the control substrate containing portion 110. This battery containing portion 60 is constituted by two containing chambers 61 and 61. In each of the containing chambers 61, two AA batteries are contained in series, and thus, four AA batteries in total are contained in the battery containing portion 60.

Moreover, as illustrated in FIG. 10B, a right-side portion when the battery containing portion 60 is divided into two portions, that is, to right and left at the center, is a battery entry/exit portion 610 for taking the battery in/out and for containing the battery, while the left-side portion is a battery storage portion 620 for storing the battery taken in through the battery entry/exit portion 610.

The battery entry/exit portion 610 has, as illustrated in FIGS. 9 and 10, three first side plates 611 for sandwiching a battery V from both sides, three lower plates 612 connecting each of the first side plates 611 from a lower side, and a second side plate 613 for connecting a right end of each of the first side plates 611. A plurality of predetermined portions in each of the first side plates 611 are elastic portions 611*a* having elasticity, and a projection portion 616 for holding the battery is formed on an end portion of each of the elastic portions 611*a* on a side opposite to the lower plate 612. Specifically, each of the elastic portions 611*a* is formed having an elongated rectangular shape, and only one of short sides of the rectangle continues to the first side plate 611. Each of the projection portions 616 is, sis illustrated in FIG. 10B, formed at a position not overlapped with the lower plates 612 when the battery entry/exit portion 610 is viewed from the side of the lower plates 612. This is to enable fabrication of the projection portions 616 and the lower plates 612 by injection molding. Moreover, the positive electrode 140 (not shown) is mounted at a spot corresponding to each of the containing chambers 61 in the second side plate 613. The battery is inserted between the adjacent first side plates 611 from, the side opposite to the lower plate 612, that is, from the front side of the battery containing portion 60 by using elasticity of each of the elastic portions 611*a*, Here, by providing the projection portions 616 on each of the first side plates 611, the inserted battery is held by the projection portions 616 and does not remove from the battery entry/exit portion 610.

The battery storage portion 620 has, as illustrated in FIGS. 9 and 10, three first side plates 621 for sandwiching the battery V from both sides, three lower plates 622 connecting each of the first side plates 621 from a lower side, a third side plate 623 for connecting a left end of each of the first side plates 621, and three upper plates 624 for connecting each of the first side plates 621 from an upper side. Here, the first side plate 621 continues to the first side plate 611 of the battery entry/exit portion 610, and the first side plate 621 and the first side plate 611 are integrated. Each of upper plates 624 is, as illustrated in FIG. 10B, arranged at a position not to overlap any of the lower plates 622 when the battery containing portion 620 is viewed from the side of the lower plates 622. This is because fabrication of the lower plates 622 and the upper plates 624 by injection molding is enabled, Moreover, the negative electrode 150 (not shown) is mounted at a spot corresponding to each of the containing chambers 61 in the third side plate 623.

Since the battery containing portion 60 is constituted as above, the battery can be easily contained in the battery containing portion 60 through the battery entry/exit portion 610 by using elasticity of the portion where each of the projection portions 616 is formed. Moreover, the battery contained in the battery containing portion 60 can be easily taken out of the battery entry/exit portion 610 by using elasticity of the portion where each of the projection portions 616 is formed.

In the first embodiment, the case of containing the four batteries in the battery containing portion is described, but in general, the number of the batteries to be contained in the battery containing portion is not limited to four but may be two, three and the like. Particularly, depending on the application, one battery may be contained in the battery containing portion. In this case, only the battery entry/exit portion needs to be provided in the battery containing portion, and the battery storage portion is not necessary.

Moreover, in the first embodiment, the battery containing portion and the spacer are integrally molded as described above. This is preferable from the economic point of view. However, if an emphasis is placed on ease of replacement of a battery or the like, the battery containing portion may be fabricated as a single body and then, mounted on the spacer.

When the air-circulating mat of the first embodiment, is used as a mat for a chair, the bag body portion 11 is placed on a seat portion of the chair with the upper sheet 100*a* directed upward so that the bag extension portion 12 is hung from the edge of the chair. Then, the user sits down on the air-circulating mat so that the buttocks are in contact with the bag body portion 11. As a result, the seating switch means 70 automatically turns on the power supply circuit and the air blowing means 40 is driven.

In the air-circulating mat of the first embodiment, by providing the battery containing portion for containing the battery so as to continue to the predetermined end portion of the spacer located on the back portion side of the user in use, when this air-circulating mat is used for the chair, the battery containing portion can be arranged so as to be located on the back side of the user and thus, even if the battery is contained in the battery containing portion, the air-circulating mat does not shift and fail from the chair by the weight of the battery. Moreover, by arranging the battery containing portion so as to be located, on the back side of the user, the weight of the battery is applied to the seating surface of the chair, close contact between the seating surface of the chair and the air-circulating mat is further improved, and the stability of the air-circulating mat is increased, whereby convenience thereof is improved.

Moreover, in the air-circulating mat of the first embodiment, by using the spacer with the structure with extremely small air resistance, power consumption of the air blowing means for causing the air to flow through the spacer can be drastically reduced. Particularly, if a dry cell is used as the power supply means, the dry cell can be used for a long time.

Furthermore, the air-circulating mat of the first embodiment is rich in flexibility since the spacer with the structure in which the adjacent convex parts are connected by the flexible connection portion with flexibility is used. Thus, for example, the air-circulating mat of the first embodiment can be folded with the side where the frame-shaped, portion is formed inside or the air-circulating mat of the first embodiment can be rolled by using the end portion of the spacer on which the battery containing portion, is formed as a core and with the side where the frame-shaped portion is formed inside. Therefore, the air-circulating mat of the first embodiment can be carried and used for various types of the seating device.

Moreover, in the air-circulating mat of the first embodiment, the spacer body portion, the spacer extension portion, the battery containing portion, the seating switch mounting portion , the control substrate containing portion, and the cable clips are integrally fabricated by injection molding of plastic and thus, it is no longer necessary to fabricate the battery containing portion or the like and the spacer separately, whereby a manufacturing cost can be drastically reduced.

Furthermore, since the air-circulating mat of the first embodiment includes the seating switch means for turning on the circuit for supplying electric power to the air blowing means from the power supply means when the user is seated, the air blowing means can be automatically operated only by sitting of the user on the air-circulating mat when the air-circulating mat is used and thus, this air-circulating mat is very convenient to be used for the user.

Since the battery containing portion is to contain the battery, this battery containing portion is thicker than the spacer body portion in general. However, the buttocks are not usually brought into contact with a rear end portion of the spacer provided so that the battery containing portion continues thereto even if a person sits on deeply. Thus, even if the thickness of the battery containing portion is slightly larger than the thickness of the spacer, a sense of discomfort in use does not occur.

[Second Embodiment]

Figure 11A:
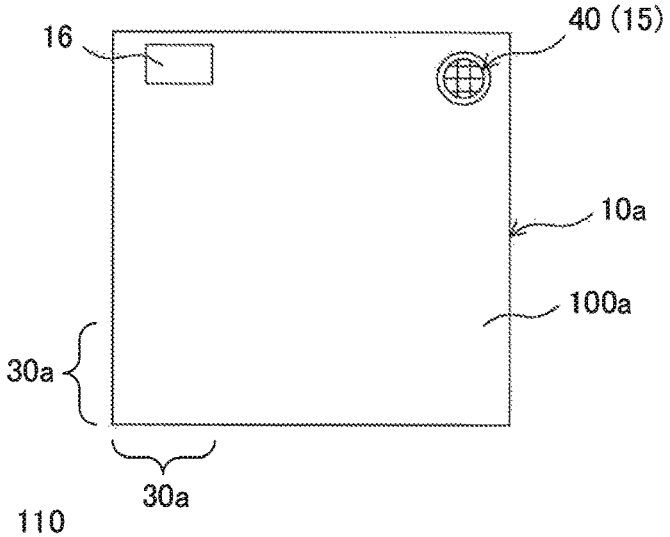
FIG. 11A is a schematic plan view of an air-circulating mat of a second embodiment.
Figure 11B:
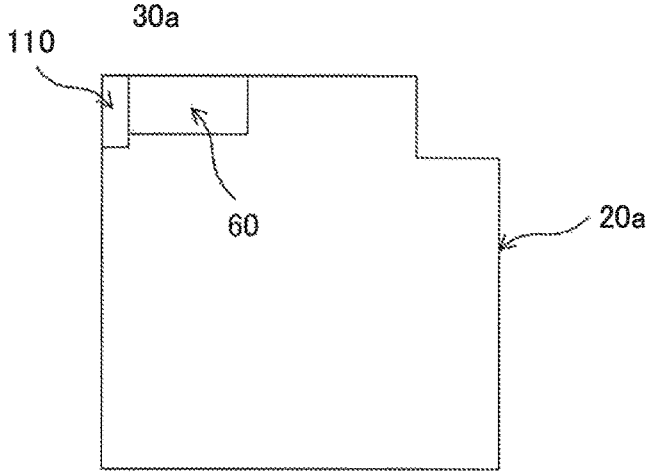
FIG. 11B is a schematic plan view of a spacer in the air-circulating mat.
Figure 11C:
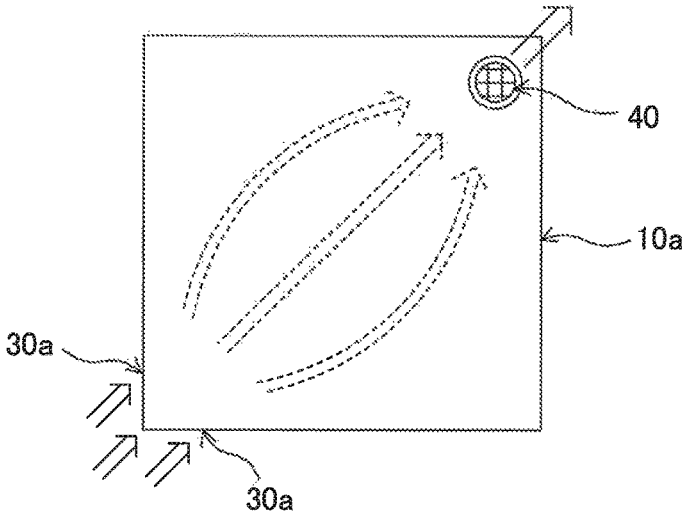
FIG. 11C is a view for explaining a flow of air in the air-circulating mat.

Subsequently, an air-circulating mat which is a second embodiment of the present invention will be described. FIG. 11A is a schematic plan view of an air-circulating mat of the second embodiment, FIG. 11B is a schematic plan view of a spacer in the air-circulating mat, and FIG. 11C is a view for explaining a flow of air in the air-circulating mat. In the second embodiment, the same reference numerals are given to those having the same functions as those in the aforementioned first embodiment, and the detailed explanation will be omitted.

The air-circulating mat of the second embodiment includes, as illustrated in FIG. 11, a bag-shaped body 10*a*, a spacer 20*a*, an air circulating portion 30*a*, the air blowing means 40, a plurality of batteries (not shown) as power supply means, the battery containing portion 60, the seating switch means 70, the seating switch mounting portion 80, the control substrate 90, the control substrate containing portion 110, the cables 120, a plurality of the cable clips 130, the two positive electrodes 140, the two negative electrodes 150, and the connector 160. Here, the seating switch means 70, the seating switch mounting portion 80, the control substrate 90, the cables 120, the plurality of cable clips 130, the two positive electrodes 140, the two negative electrodes 150, and the connector 160 are not illustrated in FIG. 11, but the same components as those in the first embodiment are used as these components.

The bag-shaped body 10*a* is to cover the spacer 20*a* and is created by sewing an upper sheet 100*a* and a lower sheet 100*b* together into a bag shape. A material from which air does not leak easily and which has moisture permeability is used for the upper sheet 100*a*, while a material from which air does not leak easily is used for the lower sheet 100*b*. The spacer 20*a* having both the normal convex parts 210A and the pressure-resistant convex parts 210B is used. The spacer 20*a*, the battery containing portion 60, the seating switch mounting portion 80, the control substrate containing portion 110, and the cable clips 130 are integrally fabricated by injection molding of plastic.

A major difference between the air-circulating mat of the second embodiment and the air-circulating mat of the first embodiment is that the bag-shaped body 10*a* is formed with an outer shape as a substantially regular square and that the opening portion 15 for mounting the air blowing means 40 is formed at a predetermined corner part of the bag-shaped body 10*a*.

Specifically, in the second embodiment, as illustrated in FIG. 11A, the outer shape of the bag-shaped body 10*a* is a substantially regular square, and the opening portion 15 is provided, at the upper right corner part of the bag-shaped body 10*a*. Thus, the spacer 20*a* whose outer shape is a substantially regular square and whose upper right corner part is missing is used as illustrated in FIG. 11B. As a result, the air blowing means 40 mounted on the opening portion 15 of the bag-shaped body 10*a* can be contained in the missing spot at the upper right corner part of the spacer 20*a*. Here, the corner part on the upper side of the spacer 20*a* is not usually touched by the buttocks even if a person is seated deeply on the chair or the like. Thus, even if the thickness of the air blowing means 40 is larger than the thickness of the spacer 20*a*, a sense of discomfort in use is not generated much. If the thickness of the air blowing means 40 is not so large, the spot of the spacer 20*a* corresponding to a mounting position of the air blowing means 40 does not necessarily have to be missing, and instead of forming the missing spot of the spacer 20*a*, devise to stably mount the air blowing means 40 may be applied at the spot of the spacer 20*a*.

Moreover, the battery containing portion 60 is provided so as to continue to a predetermined end portion of the spacer 20*a* located on a back portion side of the user in use similarly to the first embodiment. That is, in the second embodiment, the battery containing portion 60 is provided so as to continue to the spacer 20*a* at the corner part different from the corner part of the bag-shaped body 10*a* in which the opening portion 15 is formed. Specifically, in an example in FIG. 11B, the spacer 20*a* is formed having a shape such that an upper left corner part of the spacer 20*a* is missing, and the battery containing portion 60 is provided so as to continue to the spacer 20*a* of the missing portion. Therefore, the battery containing portion 60 and the air blowing means 40 are arranged separately. Moreover, the air circulating portion 30*a* is provided at a predetermined end portion of the bag-shaped body 10*a* located on the side substantially opposite to the opening portion 15 with respect to the center part of the bag-shaped body 10*a* similarly to the first embodiment. Specifically, the air circulating portion 30*a* is provided on the side surface of a lower left corner part of the bag-shaped body 10*a*.

In the second embodiment, the air blowing means 40 rotates the propeller so that the outside air is taken into the spacer 20*a* from the air circulating portion 30*a* provided on the side surface of the lower left corner part of the bag-shaped body 10*a* and the taken-in air is forcedly discharged to the outside from the air blowing means 40. Thus, when the user uses the air-circulating mat of the second embodiment, as illustrated in FIG. 11C, the outside air is taken into the spacer 20*a* from the air circulating portion 30*a* and then, flows diagonally upward and is discharged from the air blowing means 40. Here, the pressure-resistant convex parts 210B of the spacer 20*a* are preferably arranged so that the surfaces of the two wall portions are substantially in parallel with the direction in which the air flows.

The air-circulating mat of the second embodiment exerts the action/effects similar to those of the air-circulating mat of the aforementioned first embodiment. Particularly, in the second embodiment, by arranging the air blowing means at the predetermined corner part of the spacer, it is no longer necessary to provide the bag extension portion of the bag-shaped body and the spacer extension portion of the spacer and thus, a sense of discomfort on the appearance caused by hanging of the bag extension portion from, the seating surface of the seating device can be eliminated. Moreover, since there is no need to provide the spacer extension portion of the spacer, the manufacturing cost can be reduced by that cost.

In the second embodiment, the case in which the four corner parts of the bag-shaped body and the spacer are substantially at a right angle is described, but the four corner parts may be formed each having a desired, shape considering design or functionality. Moreover, since the air-circulating mat is intended to prevent stuffiness of the buttocks, the air circulating portion may be provided dispersively to each of desired spots of the bag-shaped body except the vicinity of the air blowing means. As a result, a required amount of air can be made to flow to the desired portions of the air-circulating mat.

[Other Embodiments]

The present invention is not limited to each of the aforementioned embodiments but is capable of various variations within the scope of the gist thereof.

In each of the aforementioned embodiments, the case in which the material from which the air does not leak easily is used for the lower sheet of the bag-shaped body is described, but if the seating surface itself of the seating device has a structure with less air leakage, the material from which the air does not leak easily does not necessarily have to be used for the lower sheet. Even if a material from which the air can leak easily is used for the lower sheet, since the lower sheet is in contact with the seating surface of the seating device, the air does not leak from the side of the lower sheet to the outside in the end. However, even in this case, in the first embodiment, the material from which the air does not leak easily needs to be used for the lower sheet in the bag extension portion not in contact with the seating surface of the seating device.

Moreover, in each of the aforementioned embodiments, the case in which the spacer having both the normal convex parts with the rising portion made of the four column portions and the pressure-resistant, convex parts with the rising portion made of the two wall portions is used is described, but the spacer having the normal convex parts with the rising portion made of the four column portions or the spacer having the pressure-resistant convex parts with the rising portion made of the two wall portions may be used. Moreover, the spacer having convex parts with the rising portion made of two column portions and one wall portion may be used.

Moreover, in each of the aforementioned embodiments, it is naturally possible to provide a jack on the control substrate or the like similarly to a radio, for example, which operates with less power consumption and a lower voltage so that electric power from a commercial power supply is supplied to the air-circulating mat through the jack using an AC adapter, or to supply electric power from the inside of an automobile to the air-circulating mat through the jack by using a cigar socket or a USB cable.

Moreover, in each of the aforementioned embodiments, the case in which the air-circulating mat of the present invention is used as a mat for a chair is described, but the air-circulating mat of the present invention is not limited to the mat for the chair but can be used as a mat for a sofa, a mat for a seat of an automobile and the like. Moreover, the air-circulating mat of the present invention is not limited to use by being laid on the seating device such as the chair, the sofa, and the automobile seat but can be used by being laid on any object as long as a person can sit down thereon.

INDUSTRIAL APPLICABILITY

As described above, in the air-circulating mat of the present invention, by providing the battery containing portion for containing the battery so as to continue to the predetermined end portion of the spacer located on the side corresponding to the back portion of the user in use, when this air-circulating mat is used for the seating device such as a chair, the battery containing portion can be arranged so as to be located on the back side of the user and thus, even if the battery is contained in the battery containing portion, the air-circulating mat does not shift and fall from the seating device by the weight of the battery. Moreover, by arranging the battery containing portion so as to be located on the back side of the user, the weight of the battery is applied to the seating surface of the seating device, whereby close contact between the seating surface of the seating device and the air-circulating mat is further improved and stability of the air-circulating mat is increased, and hence, convenience thereof is improved. Therefore, the present invention is particularly suitable to be used as a mat for the seating device such as a chair.

DESCRIPTION OF THE REFERENCE NUMERAL

10, 10*a* bag-shaped body
100*a* upper sheet
100*b* lower sheet
11 bag body portion
12 bag extension portion
15 opening portion
16 opening portion
20, 20*a* spacer
21 spacer body portion
22 spacer extension portion
210A normal convex part
210B pressure-resistant convex part
211 frame-shaped portion
212 column portion
213 rising connection portion
214 wall portion
220 flexible connection portion
30, 30*a* air circulating portion
40 air blowing means
60 battery containing portion
61 containing chamber
610 battery entry/exit portion
611 first side plate
611*a* elastic portion
612 lower plate
613 second side plate
616 projection portion
620 battery storage portion
621 first side plate
622 lower plate
623 third side plate
624 upper plate
70 seating switch means
80 seating switch mounting portion
90 control substrate
91 flowrate setting switch
92 main switch
110 control substrate containing portion
120 cable
130 cable clip
140 positive electrode
150 negative electrode
160 connector

The invention claimed is:

1. An air-circulating mat used by being laid on a seating device, comprising:

a bag-shaped body formed with a bag shape by an upper sheet from which air does not leak easily and a lower sheet, and having an opening portion formed on a predetermined end portion of the lower sheet or the upper sheet;

air blowing means mounted on the opening portion and causing air to flow through the bag-shaped body by forcedly suctioning the air from an outside or by forcedly discharging it to the outside;

a spacer placed between the upper sheet and the lower sheet for ensuring an air path through which the air flows substantially parallel with respective surfaces of the upper sheet and the lower sheet between the upper sheet and the lower sheet inside the bag-shaped body;

an air circulating portion provided on a predetermined end portion of the bag-shaped body located on a side substantially opposite to the air blowing means with respect to a center part of the bag-shaped body and discharging the air flowing through the air path to the outside or taking in the outside air into the air path; and a battery containing portion provided so as to continue to a predetermined end portion of the spacer located on a back portion side of a user in use and containing one or a plurality of batteries as power supply means for supplying electric power to the air blowing means;

wherein the bag-shaped body has a bag body portion arranged on a seating surface of the seating device and a bag extension portion extending from the bag body portion, wherein the opening portion is formed in the bag extension portion, wherein air does not leak easily from the lower sheet in the bag extension portion, wherein the upper sheet in the bag body portion has moisture permeability;

and wherein the spacer is made of plastic and includes a plurality of convex parts and a plurality of flexible connection portions with flexibility for connecting the adjacent convex parts, and each convex part has a frame-shaped portion, a rising portion made of four column portions, or two wall portions, or two column portions and one wall portion, each of them having a first end formed to rise from the frame-shaped portion, and a rising connection portion for connecting respective second ends of the rising portion.

2. The air-circulating mat according to claim 1, wherein:

on a portion of the spacer to be arranged on the seating surface of the seating device, convex parts with the rising portion made of the four column portions and convex parts with the rising portion made of the two wall portions are both used.

3. The air-circulating mat according to claim 1, wherein: the spacer and the battery containing portion are integrally fabricated by injection molding of plastic.

4. The air-circulating mat according to claim 1, wherein: the battery containing portion is provided so as to continue to a predetermined end portion of a portion of the spacer corresponding to the bag body portion.

5. The air-circulating mat according to claim 1, wherein: the bag-shaped body is formed so that its outer shape is a substantially regular square, the opening portion is formed at a predetermined corner part of the bag-shaped body, and the battery containing portion is provided so as to continue to the spacer at a corner part different from the corner part of the bag-shaped body at which the opening portion is formed.

6. The air-circulating mat according to claim 1, wherein: the battery containing portion includes a plurality of side plates for sandwiching the battery from both sides and a plurality of lower plates connecting the plurality of side plates from a lower side, each of the side plates has a plurality of elastic portions having elasticity and a projection portion formed at an upper end part of each of the elastic portions, each of the projection portions is formed at a position not overlapped with the lower plate when the battery containing portion is viewed from the lower side, the battery is inserted between the adjacent side plates from an upper side by using elasticity of each of the elastic portions, and the inserted battery is held by the projection portions.

7. The air-circulating mat according to claim 1, wherein: an electric component mounting portion for mounting each of electric components required for constituting a circuit for supplying electric power to the air blowing means from the power supply means is formed integrally with the spacer.

8. The air-circulating mat according to claim 1, wherein: the air-circulating mat has flexibility such that it can be folded with a side where the frame-shaped portion is formed inside or can be rolled by using an end portion of the spacer where the battery containing portion is formed as a core and with a side where the frame-shaped portion is formed inside.

9. The air-circulating mat according to claim 1, further comprising:

seating switch means for turning on a circuit for supplying electric power from the power supply means to the air blowing means when a user is seated, wherein a seating switch mounting portion for mounting the seating switch means is formed integrally with the spacer.

* * * * *